US006204825B1

(12) United States Patent
Wilz

(10) Patent No.: US 6,204,825 B1
(45) Date of Patent: Mar. 20, 2001

(54) HYBRID PRINTED CIRCUIT BOARD SHIELD AND ANTENNA

(75) Inventor: Leo J. Wilz, Cedar Rapids, IA (US)

(73) Assignee: Intermec IP Corp., Woodland Hills, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/057,923

(22) Filed: Apr. 9, 1998

Related U.S. Application Data

(60) Provisional application No. 60/043,488, filed on Apr. 10, 1997.

(51) Int. Cl.[7] ..... H01Q 1/52

(52) U.S. Cl. ..... 343/841; 343/702; 343/805

(58) Field of Search ..... 343/702, 841, 343/805, 806; 455/89, 90

(56) References Cited

U.S. PATENT DOCUMENTS

| | | | | |
|---|---|---|---|---|
| 5,428,362 | * | 6/1995 | Chatzipetros et al. | 343/702 |
| 5,585,806 | * | 12/1996 | Ogino et al. | 343/841 |
| 5,802,458 | * | 9/1998 | Van Zeijl et al. | 343/702 |
| 5,819,162 | * | 10/1998 | Spann et al. | 343/841 |
| 5,874,920 | * | 2/1999 | Araki et al. | 343/841 |

* cited by examiner

*Primary Examiner*—Tan Ho
(74) *Attorney, Agent, or Firm*—Suiter & Associates, PC

(57) ABSTRACT

A hybrid shield and antenna unit for a printed circuit board is disclosed. A shielding enclosure for providing RF and electromagnetic shielding of the electronic components of a circuit board is integrated with an antenna as a single unit. The hybrid shield and antenna combination may be fabricated as a single unit to provide for reduced steps in the manufacturing process thereby leading to improved economy. The hybrid shield and antenna includes a shielding enclosure for providing RF and electromagnetic shielding of an electronic component, and an antenna disposed at an end of said central enclosure, wherein the antenna and the central enclosure comprise a single continuous unit.

6 Claims, 5 Drawing Sheets

HYBRID PRINTED CIRCUIT BOARD SHIELD AND ANTENNA

CROSS-REFERENCE TO RELATED APPLICATION

The present application hereby claims the benefit under 35 U.S.C. § 119(e) to provisional patent application Serial No. 60/043,488 filed Apr. 10, 1997.

FIELD OF THE INVENTION

The present invention generally relates to the field of shielding printed circuit boards, and more particularly to a single shield and antenna apparatus for a printed circuit board.

BACKGROUND OF THE INVENTION

There are many applications in which it is desirable to be able to reduce the cost of construction and assembly of components and structures in electronic devices by combining the functions of multiple devices into a single structure. For example, in a hand-held portable computer, the display is often directly integrated directly into the computer housing. Thus, the hand-held computer may be made smaller, more portable and more rugged by having a single unit serving as the housing for the computer circuit boards and for the display.

In addition, it is often desirable to be able to reduce manufacturing costs by producing a single structure which simultaneously serves multiple functional purposes. For example, since an electromagnetic shielding device and an antenna must both be made of a material having a high conductivity (e.g., metal), economies of production may be realized by fabricating both the shield and the antenna from a single piece of material, thereby reducing the number of steps in required to be performed in the fabrication and assembly processes.

SUMMARY OF THE INVENTION

Accordingly, it is a goal of this invention to provide a hybrid shield and antenna for providing combination RF and electromagnetic shield and antenna apparatus.

The present invention is directed to a hybrid shielding and antenna apparatus. In one embodiment, the hybrid shield and antenna includes a shielding enclosure for providing RF and electromagnetic shielding of an electronic component, and an antenna disposed at an end of the central enclosure, wherein the antenna and the central enclosure comprise a single continuous unit.

The present invention is further directed to a shielding and radio-frequency radiator and receiver system. In one embodiment, the system includes a circuit board being generally planar and having an upper and a lower surface, the circuit board comprising a dielectric material for providing a mounting surface for an electronic component, a ground plane formed on the lower surface of the circuit board for approximating a conducting radio-frequency ground, and an enclosure disposed upon the upper surface of the circuit board and encompassing the electronic component for providing radio-frequency electromagnetic shielding of the electronic component, the enclosure having a portion thereof formed into an antenna for receiving and transmitting electromagnetic energy.

It is to be understood that both the foregoing general description and the following detailed description are exemplary and explanatory only and are not restrictive of the invention as claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to the presently preferred embodiment of the invention, an example of which is illustrated in the accompanying drawings.

Figure 1:
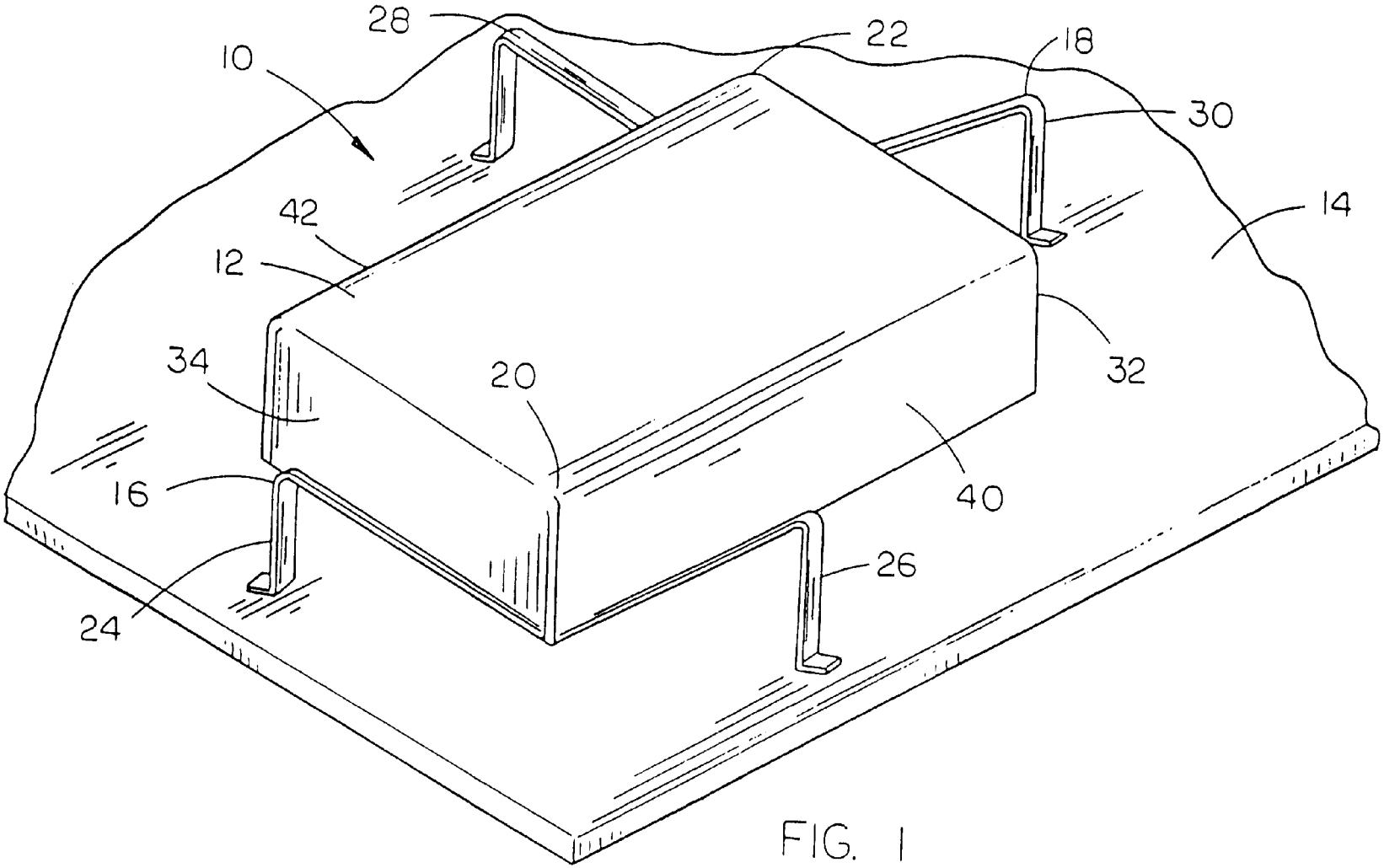
FIG. 1 is an illustration of an exemplary embodiment of a hybrid shield and antenna apparatus of the present invention.

Referring now to FIG. 1, an exemplary embodiment of the present invention is shown. The essence of the invention lies in a combination, or hybrid, shield and antenna 10. The hybrid shield and antenna 10 comprises a central enclosure 12 which functions as a shielding structure for providing RF and electromagnetic shielding of electronic circuitry disposed internally therein. The electronic circuitry may be components disposed on a circuit board 14 on which the hybrid shield and antenna 10 is utilized. The hybrid shield and antenna 10 includes one or more antenna structures 16 and 18 which may be disposed at corners 20 and 22 of the central enclosure 12. Each antenna 16 and 18 may comprise radiating elements 24, 26, 28 and 30 which may vary in structure and form according to the particular type and design of the antennas 16 and 18. For example, the antennas may be designed as bow-tie antennas, quarter-wavelength or half-wavelength, etc.

The term antenna as referred to herein may include any device which confines accelerating electrical charges to produce or receive far field traveling wave energy with the desired directional and polarization properties. The antennas 16 and 18 may be constructed according to design criteria to provide a structure that is reasonably sized, light weight, robust, inexpensive, and reliable and has the desired electromagnetic properties for the given application. The preferred applications of the hybrid shield and antenna 10 of the present invention include portable, hand-held electronic computer-based data collection and processing terminals.

Ideally, the antennas 16 and 18 of the present invention are isotropic antennas in that the antennas radiate equally in all directions. The antennas 16 and 18 of the present invention may comprise, but are not limited to, any of the following types of antennas: Adcock, Alexanderson, anisotripoc, bent, biconical, bobtail curtain, bow tie, center feed, circular, coaxial, conical, corner reflector, cross-antenna, current feed, current loop, current node, delta matched, diplex, dipole, doublet, directional, discone, dish, double-V, double-zepp, drooping radial, end feed, end fire, extended double-zepp, ferrite rod, fishbone, flagpole, flat top, folded dipole, Fuchs, ground plane, half-wave, halo, herp, helical, Hertz, horn, inverted-L, isotropic, J-antenna, J-pole, Kooman, L-antenna, lead-in, loaded, loading disk, log-periodic, long wire, loop, Marconi, monopole, multi-band, multi-element, multiplex, noise-reducing, off-center feed, omnidirectional, phased array, polyphase, quad, rhombic, side stacking, sleeve, spherical, spider web, stacking, Sterba, T-antenna, tapered feed line, top-loaded, trap, turnstile, umbrella, unidirectional, V-beam, vertical, vertical dipole, whip, window, wire, Yagi, or Zeppelin.

Figure 2:
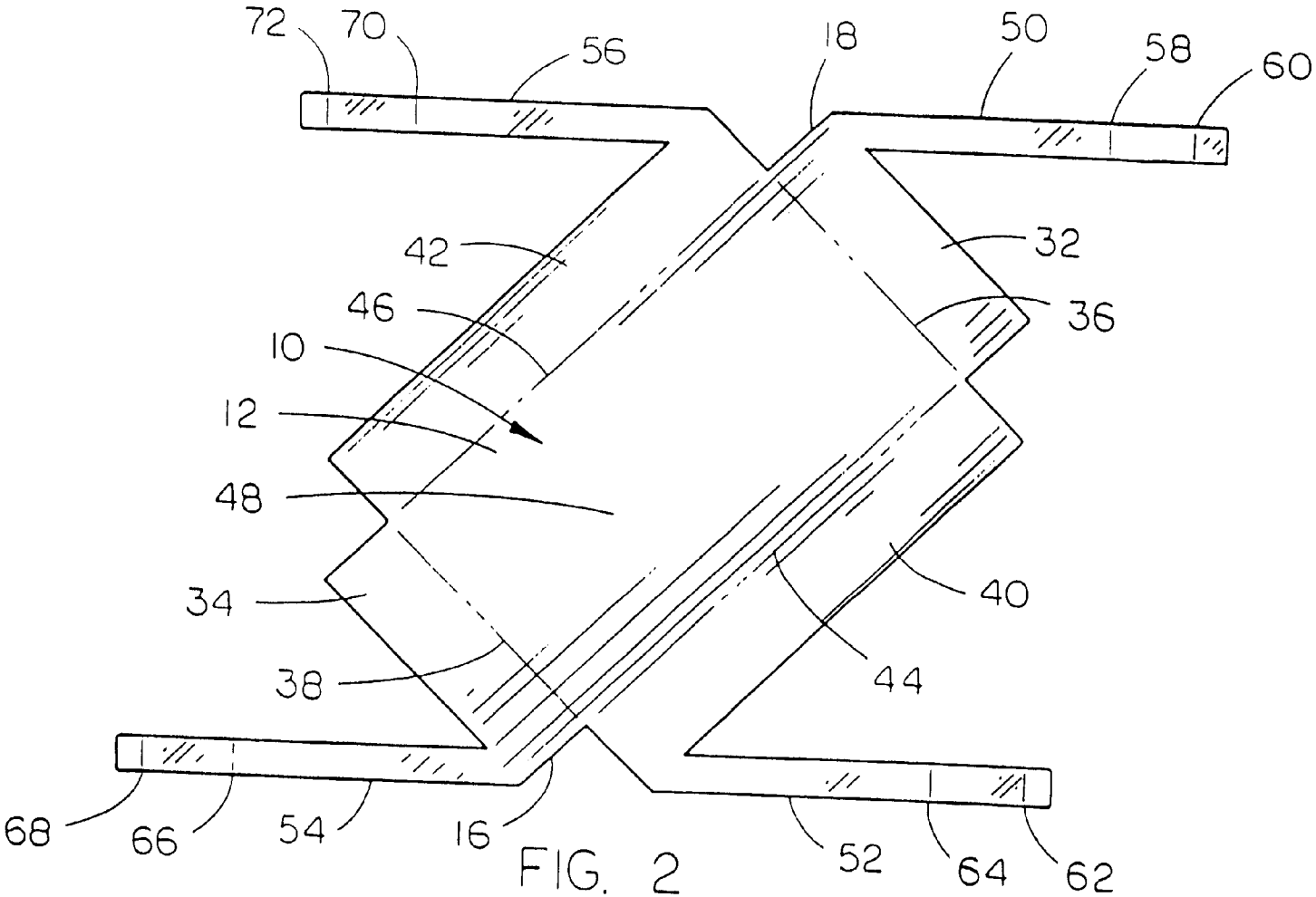
FIG. 2 is an illustration of a pre-formed flattened shape of the hybrid shield and antenna of FIG. 1 in accordance with the present invention.

Referring now to FIG. 2, a hybrid shield an antenna of the present invention in a pre-formed flattened shape is shown. The hybrid shield and antenna 10 is preferably fabricated from a single sheet of material. The shield and antenna 10 may be fabricated with an etching process to produce the necessary structural elements comprising the shield and antenna unit. For example, in the etching process in which the hybrid shield and antenna 10 is formed, an unformed metal plate may be coated with an acid-resistant ground covering an entire surface thereof. The desired shape or image of the hybrid shield and antenna structure is then drawn or traced into the ground, thereby exposing the metal areas in the plate to be removed in forming the desired structures. The plate may then be immersed in an acid bath such that the acid dissolves away only areas from which the acid-resist has been removed, the rest of the areas being protected from reacting with the acid by the ground. After the acid has completely dissolved the exposed areas of the plate, the acid-resist is then removed from the remaining metal in the pre-formed desired shape.

The pre-formed desired shape of the hybrid shield and antenna 10 is depicted in FIG. 2. Flaps 32 and 34 may be folded along fold lines 36 and 38, respectively, to form vertical end surfaces of the central enclosure 12. Similarly, flaps 40 and 42 may be folded along fold lines 44 and 46, respectively, to form vertical side surfaces of the central enclosure 12. The remaining central surface 48 of the pre-formed shape is thereby becomes the top surface of the central enclosure 12 such that the central enclosure is elongate and generally rectangularly shaped, although other similar shapes may be formed as well. Extensions 50, 52, 54 and 56 may be folded along fold lines 58 and 60, 62 and 64, 66 and 68, and 70 and 72, respectively, to arrive at the necessary shape and structure of the radiating elements 24, 26, 28 and 30. For example, the structure of the radiating elements 24, 26, 28 and 30 may be generally triangular to implement bow tie type antennas. A bow tie antenna is a broadband antenna typically utilized for transmitting and receiving vhf and uhf frequencies down to approximately 20 MHz. A bow tie antenna typically comprises two triangular pieces of stiff wire or flat metal plates wherein the transmission line feeds at the apexes of the triangles. A reflecting screen may be disposed on a side of the bow tie radiators to provide a unidirectional operation if so desired. In the present invention, vertical sides 34 and 40 of the central structure 14 may function as such a reflecting screen, for example.

Alternatively, radiating elements 50, 52, 54 and 56 may be formed to implement a bent antenna. A bent antenna may be generally considered as any antenna with a radiating element that is not straight. A bent antenna configuration is typically utilized in installations that cannot accommodate a full-sized antenna for the desired operational frequency. The utilization of a bent antenna may be desirable in a handheld portable electronic device such as a portable computer terminal of compact design wherein usable space is only available at a design premium.

Figure 3:
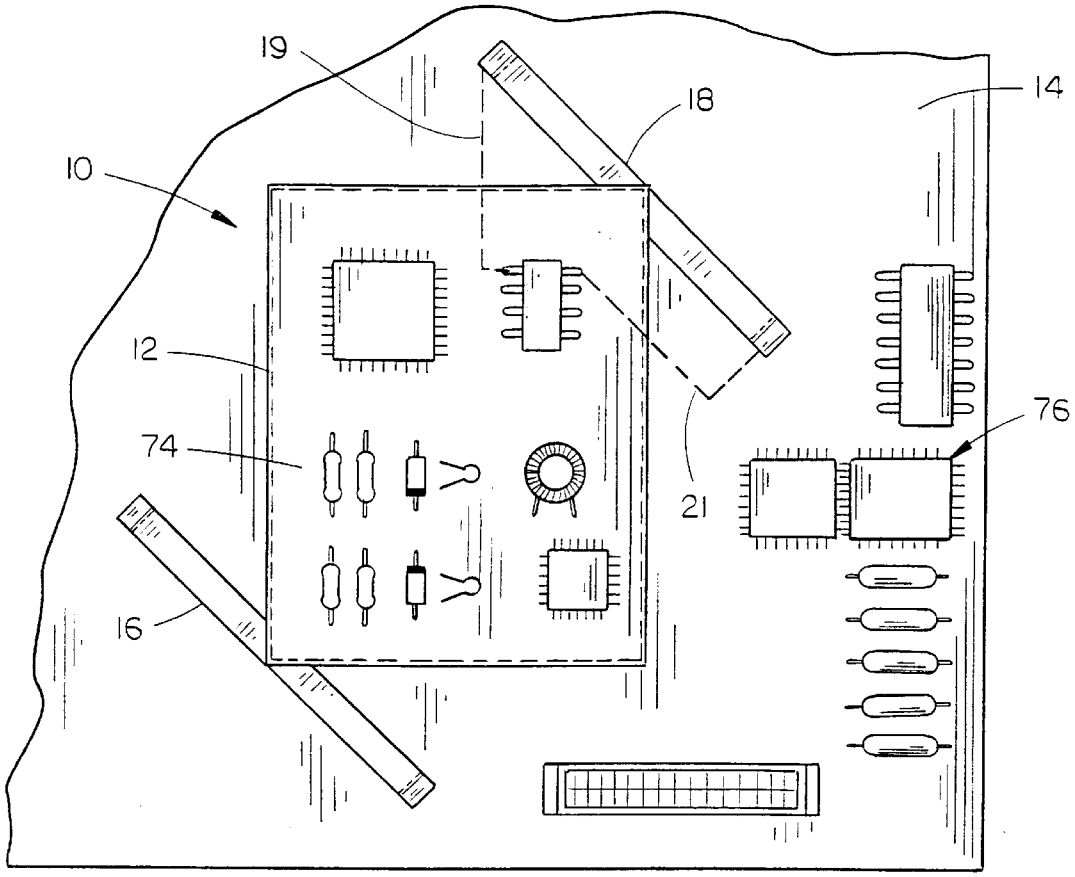
FIG. 3 is an illustration of a top plan view of the hybrid shield and antenna shown in FIG. 1.
Figure 4:
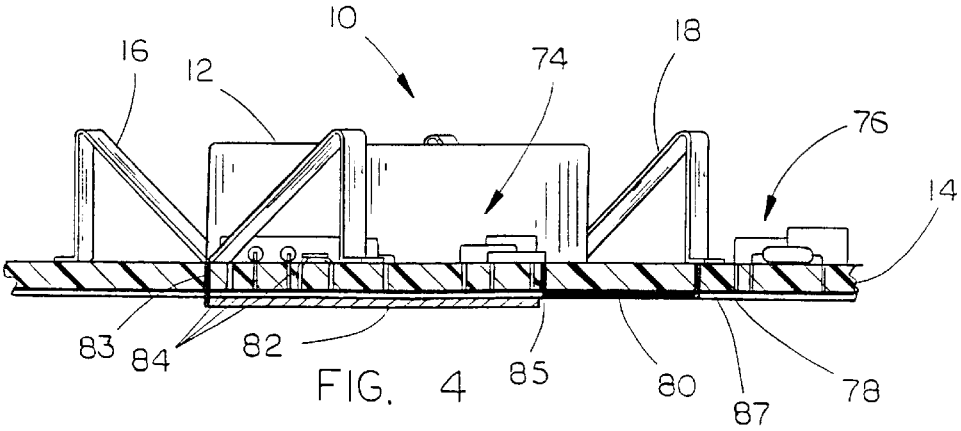
FIG. 4 is an illustration of an end elevation view of the hybrid shield and antenna shown in FIG. 1.

Referring now to FIGS. 3 and 4, a top plan and an end elevation view, respectively, of the hybrid shield and antenna 10 of the present invention are shown. The central enclosure 12 is shown as providing an RF or electromagnetic shield enclosure for internal electronic components 74 for which shielding is required. For example, the internal electronic components 74 may be the components of an RF transceiver operating at radio-frequencies disposed on circuit board 14. At such frequencies, the internal electronic components 74 may produce undesirable radio-frequency electromagnetic radiation which would otherwise adversely interfere via reactive coupling with the operation of nearby exterior electronic components also disposed on circuit board 14 without the shielding effects of the hybrid shield and antenna 10.

Alternatively, external electronic components 76 may comprise an RF transceiver to be protected from electromagnetic interference from internal electronic components which may be data circuits operating at high switching speeds, for example. In this situation, the shielding structure 12 protects the external electronic components 76 from electromagnetic radiation emanating from internal data circuits 74 which would otherwise interfere with the operation of the external RF transceiver 76. Without the shielding action provided for data circuits 74 by the shielding structure 12, the RF transceiver would undesirably broadcast the high speed switching signals thereby interfering with RF communications. Conversely, enclosure 12 protects electronic components 74 from RF interference generated by electronic components 76.

As shown in FIG. 3, antenna 18 is connected to electronic circuit components 74 via traces 19 and 21. Traces 19 and 21 serve as a transmission line for coupling antenna 18 to electronic components 74 such that signals generated by electronic components 74 may be transmitted via antenna 18, or such that signals in the form of electromagnetic waves may be received by antenna 18 and transmitted to electronic components 74.

Referring more specifically to FIG. 4, the circuit board 14 of the present invention is shown having an electrical connection plane 78 having electrical traces 80 thereon for forming connections between the electronic components 74 and antenna 18 of the circuit board 14. Electrical traces 80 may correspond to the transmission line traces 19 and 21 of FIG. 3. Electrical traces 80 of electrical connection plane 78 may comprise standard solder traces, for example. Alternatively, electrical traces 80 of electrical connection plane 78 may comprise microstrip traces, planar transmission lines comprising thin conducting strips of finite width typically utilized to form an unbalanced transmission line for implementing an image conductor in conjunction with a ground plane 82. The microstrip traces may be utilized as transmission lines to feed the signal from the circuits 74 and 76 to the antennas 16 and 18 to minimize external radiation since the effective current in the image conductor is equal in magnitude but opposite in direction to the current in the actual conductor. Connection vias 84 provide passageways and connections through the circuit board 14 to allow for the electronic components 74 and 76 to connect to electrical traces 80 and ground plane 82 of the electrical connection plane 78.

Connection via 83 connects enclosure 12 to shield plane 82, thereby improving the shielding effectiveness and continuity of hybrid shield and antenna 10. Connection vias 85 and 87 connect circuit components 74 and antenna 18 to electrical trace 80 such that signals may enter or leave enclosure 12.

Figure 5:
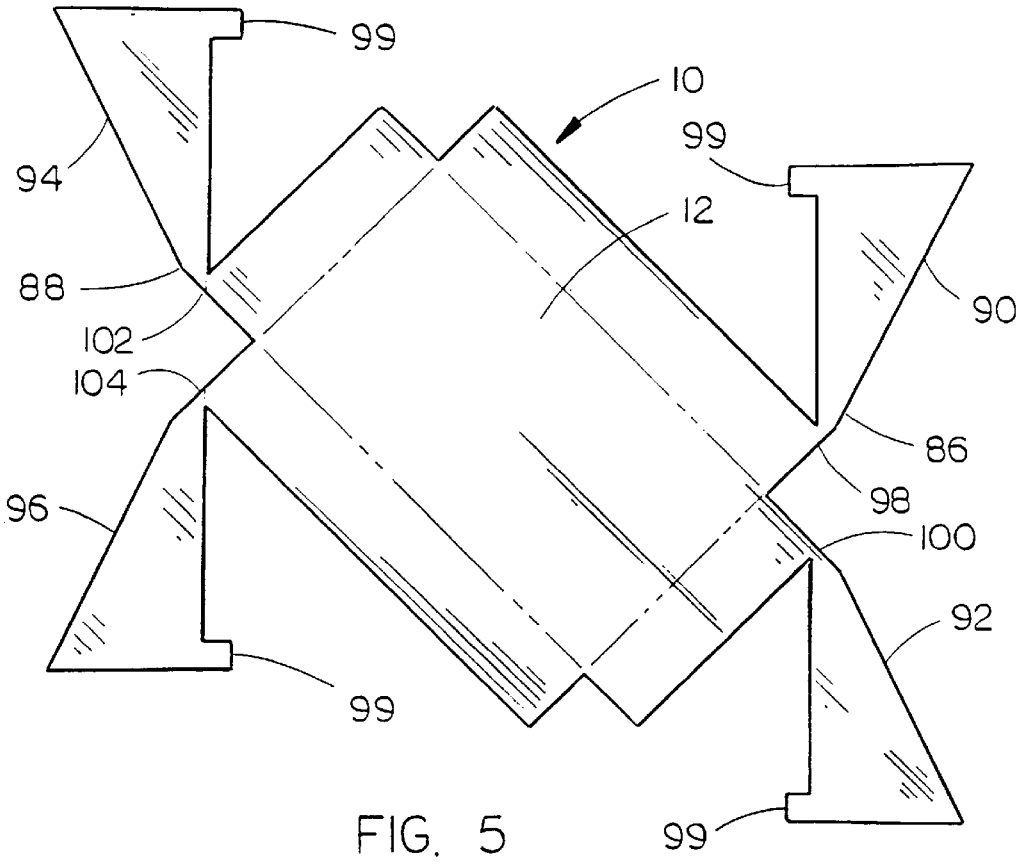
FIG. 5 is an illustration of a top plan view of a pre-formed alternative hybrid shield and antenna of the present invention.

Referring now to FIG. 5, a top plan view of a pre-formed hybrid shield and antenna of the present invention is shown. Through variations in the etching process by which the hybrid shield and antenna 10 of the present invention is formed, various types of antennas may be formed. For example, the bow tie antenna configuration as shown in FIG. 2 in which the wire strip form of bow tie antennas 16 and 18 is utilized may be an alternative form of bow tie antennas 86 and 88 as shown in FIG. 5. The radiating elements 90 and 92 and 94 and 96 of bow tie antennas 86 and 88, respectively, may comprise flat metallic sheets rather than the wire strip form of FIG. 2. Thus, radiating elements 90, 92, 94 and 96 may be folded about fold lines 98, 100, 102 and 104, respectively, to form complete bow tie antennas 86 and 88 of the hybrid shield and antenna 10 of FIG. 6. Feed points 99 of radiating elements 90–94 provide a point at which electrical traces such as traces 19 and 21 may connect to electronic components 74.

Figure 6:
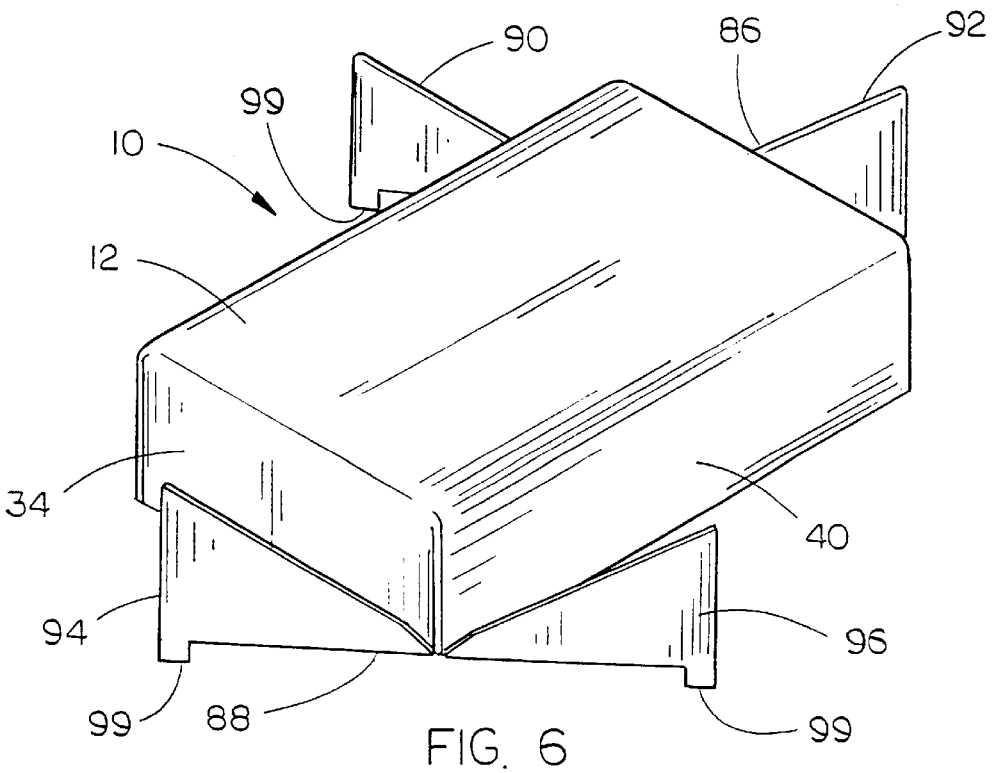
FIG. 6 is an illustration of an alternative hybrid shield and antenna of the present invention based upon the pre-form pattern shown in FIG. 5.

Referring now to FIG. 6, a hybrid shield and antenna of the present invention is shown illustrating an alternative form of antennas. The hybrid shield and antenna 10 depicted in FIG. 6 is the resulting product when the pre-formed shield and antenna piece 10 of FIG. 5 is formed into a completed unit. The vertical surfaces 34 and 40 of the central enclosure 12 may function as reflecting screens in a manner substantially similar to the manner described with respect to the hybrid shield and antenna embodiment of FIG. 1. Feed points 99 of radiating elements 90–96 provide a point at which electrical traces such as traces 19 and 21 may connect to electronic components 74.

Figure 7:
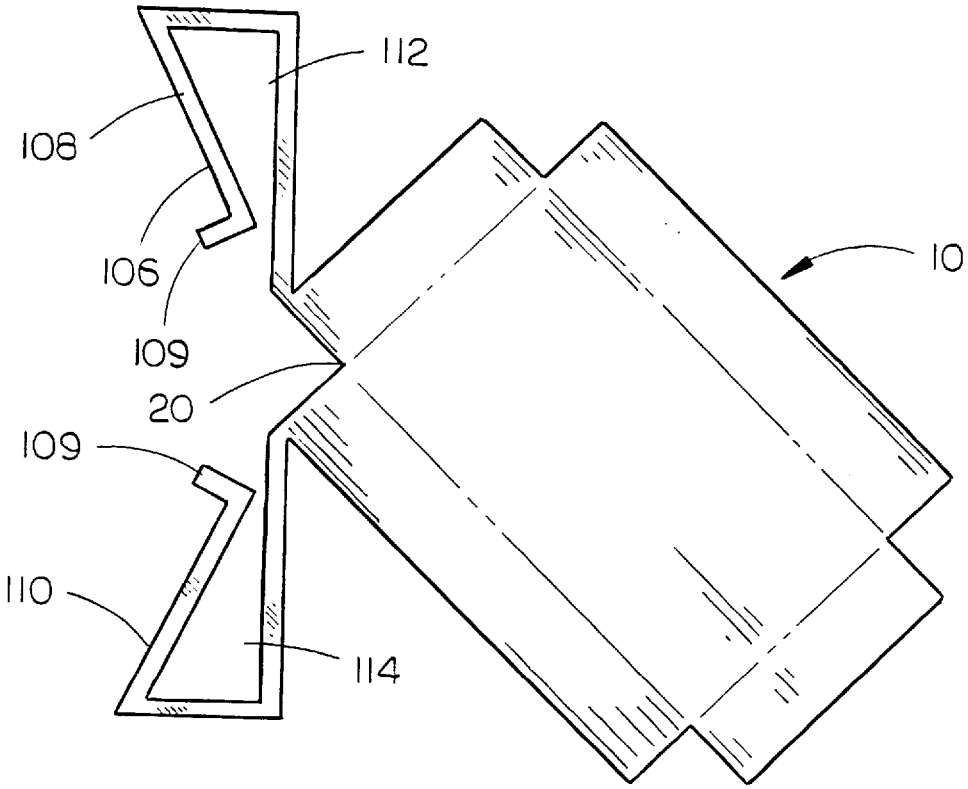
FIG. 7 is an illustration of a top plan view of a pre-formed further alternative hybrid shield and antenna of the present invention.
Figure 8:
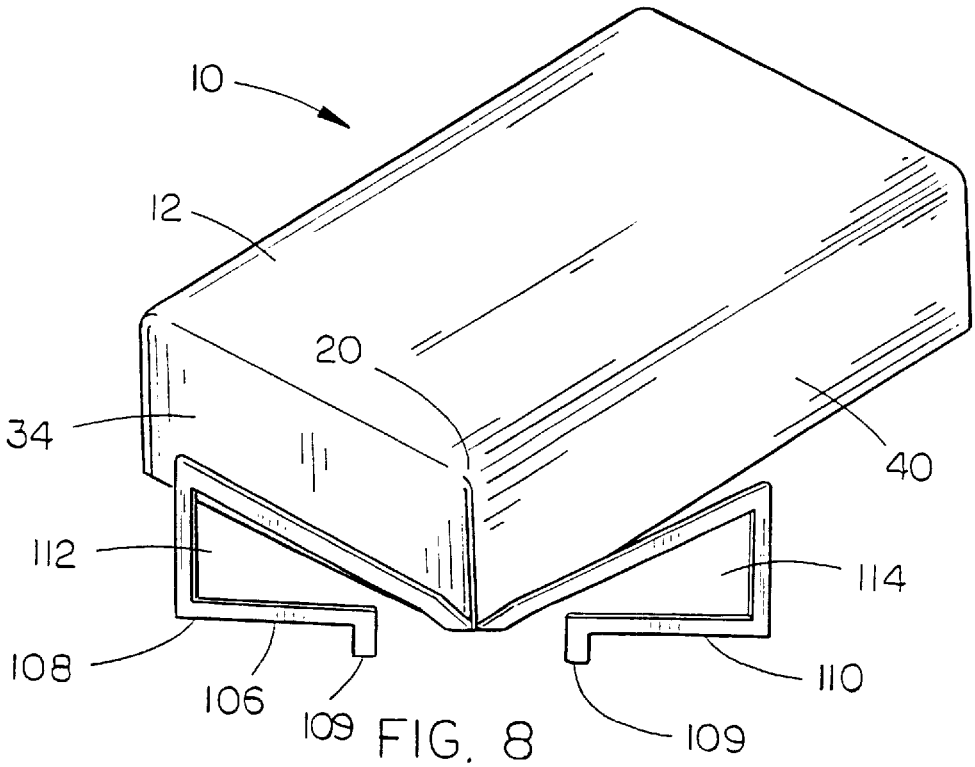
FIG. 8 is an illustration of a further alternative hybrid shield and antenna of the present invention based upon the pre-form pattern shown in FIG. 7.

Referring now to FIGS. 7 and 8, a hybrid shield and antenna of the present invention is shown further illustrating an alternative form of antenna. As the antennas 16 and 18 of FIGS. 1 and 2 may be modified to implement antennas 86 and 88 of FIGS. 5 and 6, many various modifications in the antenna form factor may be achieved as further illustrated in FIGS. 7 and 8. For example, the hybrid shield and antenna 10 may include only a single antenna 106 disposed at a corner 20 of the hybrid shield and antenna 10. The antenna 106 may include radiating elements 108 and 110 which are similar to radiating elements 90 and 92 of antenna 86 of FIG. 5, for example, with the exception of having triangularly shaped hollow central regions 112 and 114. It may be desirable for radiating elements 108 and 110 to include hollow central regions 112 and 114 to improve or modify the effective reflective surface area of the surfaces 34 and 40 in acting as reflectors for antenna 106 in order to thereby achieve an appropriate gain or main lobe and side lobe patterns of the antenna 106, for example. Feed points 109 of radiating elements 108 and 110 provide a point at which electrical traces such as traces 19 and 21 may connect to electronic components 74.

Thus, the antenna form factor of the present invention may be designed according to design criteria necessary to implement the desired antenna operational characteristics. Such design criteria may include, for example, power gain, main beam lobe and side lobe patterns and sizes, polarization, axial ratio, directivity, bandwidth, operational frequency and wavelength, voltage standing wave ration (VSWR) and effective area.

It is believed that the hybrid printed circuit board shield and antenna of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A hybrid shielding and antenna apparatus, comprising:

a shielding enclosure for providing RF and electromagnetic shielding of an electronic component; and an active antenna portion disposed at an end of said shielding enclosure, said active antenna portion and said shielding enclosure comprising a single continuous unit pre-formed from a single piece of material.

2. The hybrid shielding and antenna apparatus as claimed in claim 1, wherein said active antenna portion is a bow tie antenna.

3. The hybrid shielding and antenna apparatus as claimed in claim 1, wherein said active antenna portion is a bent antenna.

4. A shielding and radio-frequency radiator and receiver system, comprising:

a circuit board being generally planar and having an upper and a lower surface, said circuit board comprising a dielectric material for providing a mounting surface for an electronic component;

a ground plane formed on a surface of said circuit board for providing a conducting radio-frequency ground; and an enclosure disposed upon the upper surface of said circuit board and encompassing the electronic component for providing radio-frequency electromagnetic shielding of the electronic component, said enclosure having a portion thereof formed into an active antenna for receiving and transmitting electromagnetic energy, said enclosure and said active antenna being preformed from a single piece of material.

5. The system as claimed in claim 4, wherein said active antenna is a bow tie antenna.

6. The system as claimed in claim 4, wherein said active antenna is a bent antenna.

* * * * *